US012233304B2

(12) United States Patent
Schough et al.

(10) Patent No.: US 12,233,304 B2
(45) Date of Patent: Feb. 25, 2025

(54) WEIGHTLIFTING DISC WITH A REINFORCEMENT DEVICE

(71) Applicant: Eleiko Group AB, Halmstad (SE)

(72) Inventors: Camilla Schough, Gullbrandstorp (SE); Stefan Berg, Halmstad (SE)

(73) Assignee: ELEIKO GROUP AB, Halmstad (SE)

( * ) Notice: Subject to any disclaimer, the term of this patent is extended or adjusted under 35 U.S.C. 154(b) by 193 days.

(21) Appl. No.: 17/923,046

(22) PCT Filed: May 4, 2020

(86) PCT No.: PCT/SE2020/050441
§ 371 (c)(1),
(2) Date: Nov. 3, 2022

(87) PCT Pub. No.: WO2021/225478
PCT Pub. Date: Nov. 11, 2021

(65) Prior Publication Data

US 2023/0146167 A1 May 11, 2023

(51) Int. Cl.
*A63B 21/072* (2006.01)

(52) U.S. Cl.
CPC ..... *A63B 21/0728* (2013.01)

(58) Field of Classification Search
CPC ..... A63B 21/0607; A63B 21/072; A63B 21/0722; A63B 21/0724; A63B 21/0728; A63B 21/075; A63B 2071/0063
See application file for complete search history.

(56) References Cited

U.S. PATENT DOCUMENTS

| | | | | |
|---|---|---|---|---|
| 9,682,268 | B2 * | 6/2017 | Breitkreutz | A63B 21/072 |
| 10,773,117 | B1 * | 9/2020 | Goldberg | A63B 21/0724 |
| 2010/0022359 | A1 * | 1/2010 | Lin | A63B 21/0724 482/93 |

(Continued)

FOREIGN PATENT DOCUMENTS

| | | | |
|---|---|---|---|
| CN | 2158738 | Y | 3/1994 |
| DE | 2419221 | A1 | 10/1975 |

(Continued)

OTHER PUBLICATIONS

International Search Report and Written Opinion from corresponding International Application No. PCT/SE2020/050441, mailed on Mar. 12, 2020, 10 pages.

*Primary Examiner* — Megan Anderson
*Assistant Examiner* — Jonathan A Dicuia
(74) *Attorney, Agent, or Firm* — Tucker Ellis LLP

(57) ABSTRACT

Disclosed is a weightlifting disc (1) which comprises a disc part (10) of elastomeric material, wherein the disc part (10) comprises an outer edge (11) and an inner edge (12), wherein the inner edge (12) is arranged close to a center (13) of the disc part (10) and the outer edge (11) of the disc part (10) is distal from the center (13) of the disc part (10). The weightlifting disc (1) further comprises at least one reinforcing device (20), arranged into the disc part (10) circumferentially around the center (13), between the outer edge (11) and the inner edge (12) of the disc part (10), wherein the reinforcing device (20) is arranged at a distance (a) from the inner edge (12) of the disc part (10) such as elastomeric material is arranged between the inner edge (12) of the disc part (10) and the reinforcing device (20).

18 Claims, 5 Drawing Sheets

(56) References Cited

U.S. PATENT DOCUMENTS

| | | | | |
|---|---|---|---|---|
| 2015/0231441 | A1* | 8/2015 | Davies, III | A63B 21/0728 482/107 |
| 2020/0360755 | A1* | 11/2020 | Rothschild | A63B 21/0607 |

FOREIGN PATENT DOCUMENTS

| | | | | |
|---|---|---|---|---|
| FR | 1263930 | A | 6/1961 | |
| FR | 2459056 | A1 | 1/1981 | |
| WO | WO-2020117805 | A1 * | 6/2020 | A63B 21/0604 |

* cited by examiner

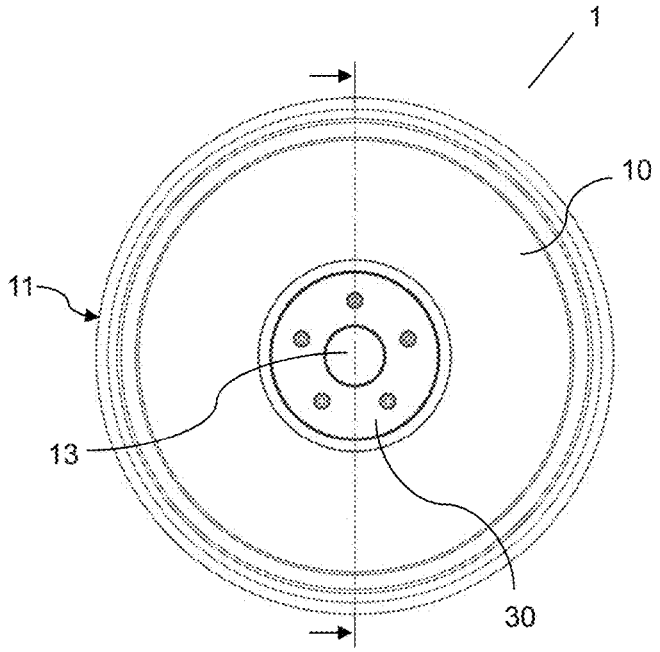
Fig. 2a
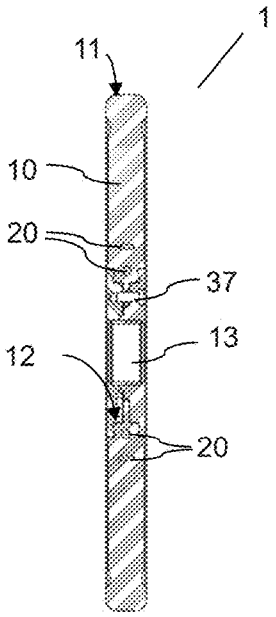
Fig. 2b
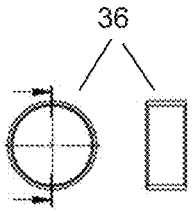
Fig. 3a-b
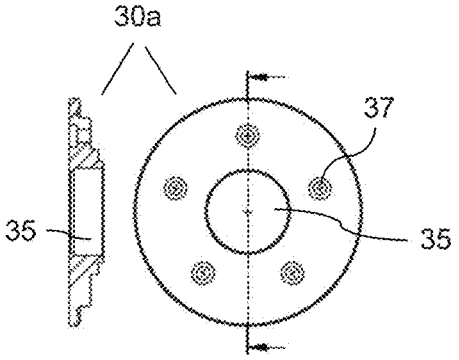
Fig. 3c-d
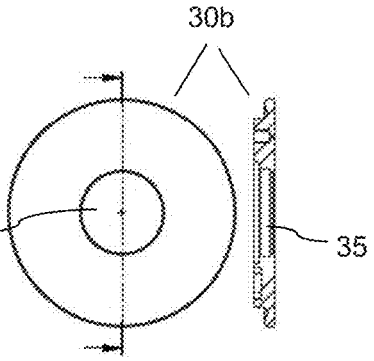
Fig. 3e-f

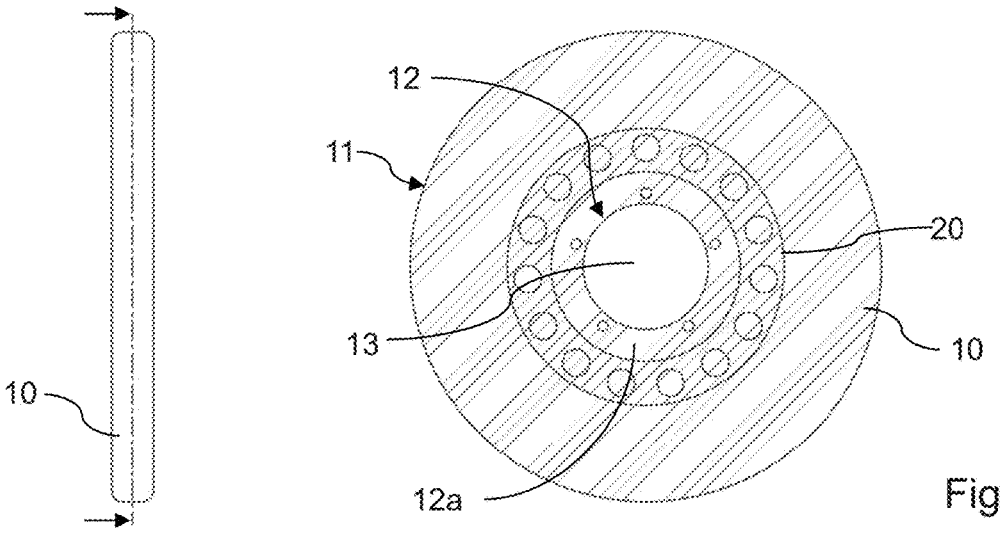
Fig. 4a-b
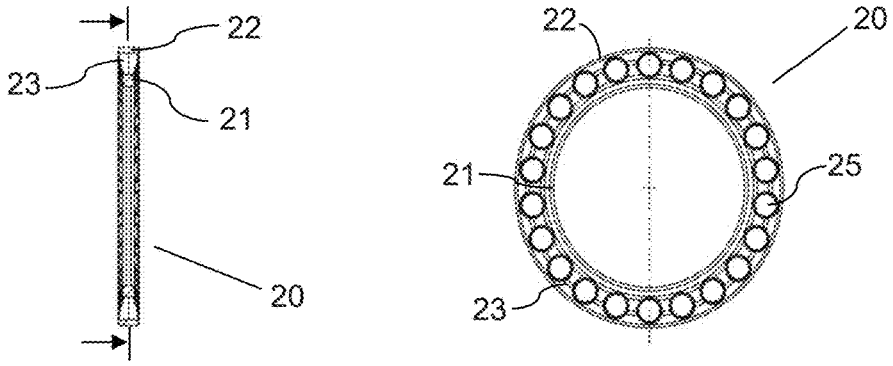
Fig. 4c-d
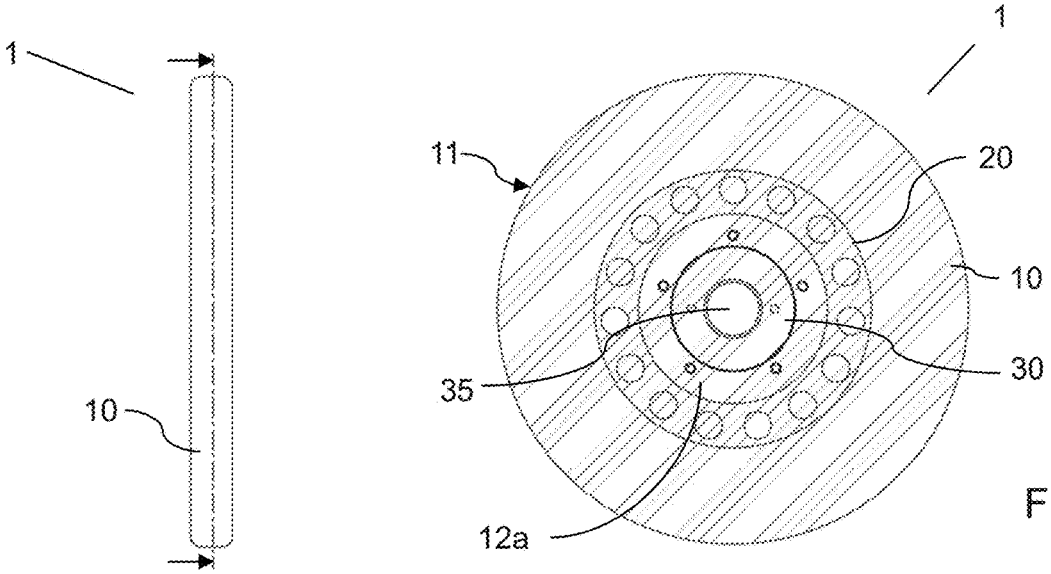
Fig. 4e-f

WEIGHTLIFTING DISC WITH A REINFORCEMENT DEVICE

TECHNICAL FIELD

The invention considers a weightlifting disc to be used on a bar.

BACKGROUND ART

Earlier, weightlifting discs were made as solid metal disc plates, but nowadays weightlifting discs normally are made of a soft material like rubber or other elastomeric material with a central hub. Competition weights as well as training discs are normally made of rubber or other elastomeric compositions with high durability and are provided with a metal hub. The elastomeric (soft) material is used to absorb the shock and deceleration when a weightlifter drops or bumps the weights against the floor, which results in a better sound dampening and shock absorption. The metal hub provides a longer lifetime of the weight disc since there is deformation (tensioning) of the soft material around the center hole of the disc when dropped on the floor repeatedly.

The metal hub is of course positive for the lifetime of the disc, but yet there is a problem with the strength of the weight disc over time. One problem with these "soft" discs with a metal hub (or other hard material) is that the available area for distribution of a shock force between the metal hub and the surrounding softer disc, when the barbell with the weight disc is dropped on the floor, is limited to the interaction surface between the hub and the disc. This means that a great impact force acts on a small area of the soft weightlifting disc material which results in a tension peak at the impact area and a local deformation of the material, which is negative for the lifetime of the weightlifting disc. Over time, this also results in a gap between the hub and the disc part.

Thus, there is a need of an improved strength of a weightlifting disc to lengthen the lifetime of a weightlifting disc of elastomeric material.

SUMMARY OF THE INVENTION

It is an object of the invention to address at least some of the problems and issues outlined above. It is possible to achieve these objects and others by a weightlifting disc as defined in the attached independent claims.

According to an aspect of the invention, a reinforced weightlifting disc to be arranged on a bar is disclosed. The weightlifting disc comprises a disc part of elastomeric material, wherein the disc part comprises an outer edge and an inner edge, wherein the inner edge is arranged close to a center of the disc part and the outer edge of the disc part is distal from the center of the disc part. The weightlifting disc further comprises at least one reinforcing device, arranged into the disc part circumferentially around the center, between the outer edge and the inner edge of the disc part, wherein the reinforcing device is arranged at a distance from the inner edge of the disc part such as elastomeric material is arranged between the inner edge of the disc part and the reinforcing device.

By this design, an impact force transferred from the floor via the disc part to the bar, is spread out over a large area via the circumferentially arranged reinforcing device. Further, by that the reinforcing device is arranged into the disc part at a distance from the inner edge (radially seen) such as elastomeric material is arranged between the inner edge and the reinforcing device, a dampening effect is disclosed as well as that the impact force in a certain part/direction is distributed to a larger area of the reinforcing device and further to the disc part before it reaches the bar. The risk of crack formation in the elastomeric material (rubber) is significantly reduced due to the force distribution and the risk of an increase of the gap between a hub part (if applicable) and the elastomeric disc part is significantly reduced. By that, the form of the disc is kept over time and tests show that the lifetime of the weightlifting disc of elastomeric material is significantly lengthened. Another aspect is that the individual disc part may be thinner such as more discs may be applied on the bar. No prior art solution provides a weightlifting disc with all these advantages.

According to an embodiment, the reinforcing device is substantially ring-shaped. Such a solution provides a good distribution of impact forces between the disc part and the bar, wherein the forces are circumferentially distributed around substantially the whole disc part, i.e. in all directions before the transfer to the bar.

According to an embodiment, the reinforcing device comprises spaced holes arranged to accommodate elastomeric material of the outer disc part. By having a number of holes distributed around the reinforcing device, which holes are arranged to accommodate elastomeric material, the transfer area available for distributing and take care of an impact force via the reinforcing device and disc part is greatly increased compared to a solid reinforcing device. Further, the reinforcing device gets good contact with the elastomeric material without the need of any pretreatment of the surfaces of the reinforcing device, which normally is needed when for example moulding different materials together; like metal and rubber for example.

According to an embodiment, the weightlifting disc further comprises a hub part arranged at the center of the disc part, wherein the disc part substantially surrounds the hub part when the hub part is arranged at the center of the disc part. The hub part is arranged to be attached at the inner edge of the disc part, and the hub part comprises a center hole for receiving a bar. A hub part, preferably made of metal, provides a complement to the reinforcing device because it also provides a transfer of an impact force from the disc part, via the hub part and further to the bar. Since there is elastomeric material between the inner edge of the disc part and the reinforcing device, there is elastomeric material between the reinforcing material and the hub part, which is positive as described above. The hub part may also be attach to the sides of the disc part, at least close to the inner edge of the disc part, which means that the hub part may serve both as a sleeve through the weightlifting disc, arranged to be in contact with the bar, by the attachment to the inner edge, and further as a reinforcement due to the contact with a part of the sides around the center of the disc.

According to an embodiment, the inner edge of the disc part comprises at least a protruding part which protrudes radially towards the center of the disc part, wherein the protruding part is arranged to be attached to the hub part. The protruding part is arranged as a protruding lip which is arranged around the inner edge of the disc part and thus extends towards the center of the weightlifting disc. The protruding part increases the distance between the reinforcing device and the inner edge of the disc part and if a hub is arranged at the inner edge, it increases the transferring area between the hub part and the disc part and provides a good fixation between the disc part and the hub part since the protruding part may be pressed between the two halves of the hub part, if the hub part is designed in that way.

According to an embodiment, the reinforcing device is made of metal. Preferably the metal is cast iron, which is a robust material well suited for the purpose, but other materials like steel, light metals like aluminium or the like may be used.

According to an embodiment, the reinforcing device is made of plastic. A plastic material provides a cost efficient solution for providing a reinforced weightlifting disc.

According to an embodiment, the reinforcing device and the disc part are moulded together to a unit such as the elastomeric material of the disc part encloses the reinforcing device.

In yet an embodiment, the hub part comprises two halves connectable to each other, wherein at least the inner edge of the disc part is arranged to be pressed between the two halves of the hub part when they are connected to each other. Such a solution is very good since the two halves so to speak clamps the disc part (and the protruding part if applicable) from both sides whereby a solid and robust attachment of the hub part is achieved as well as large area for transfer of the sudden impact force from a drop of the barbell with the assembled weightlifting discs. The two halves may preferably extend radially a distance from the center, which is enough to "enclose" at least a part of the disc part in which the reinforcing device is arranged, which by that is arranged with at least a part (nearest the inner edge) between the two halves.

According to an embodiment, the reinforcing device comprises a substantially cylindrical inner ring, a substantially cylindrical outer ring and an annular body connecting the inner ring and the outer ring. The reinforcing device looks more or less like a rim of a wheel, wherein the rings and annular body may have equal or different widths. For example, the outer ring may be wider than the inner ring or vice versa and the annular body may be thinner or wider than the outer ring and/or the inner ring. If the reinforcing device comprises holes, these may be arranged in any of the inner ring, the outer ring and the annular body. The ring-shaped reinforcing device is easy to manufacture the continuous ring-shape is very good for taking care of the impact force and distribute it along the reinforcing device and further to the disc part.

According to an embodiment, the annular body of the reinforcing device comprises a plurality of holes circumferentially distributed along the annular body and transverse the annular body. The holes are arranged to accommodate the elastomeric material of the disc part, and since the weightlifting device preferably is produced by moulding the reinforcing device and the disc part together to one unit, the reinforcing device transfers a shock force very well to the elastomeric material and over a large area, which is very positive for the lifetime of the weightlifting disc By that the holes are filled with elastomeric disc material, the material in the holes act as transverse beams in cooperation with the reinforcing device. The solution is very strong compared to prior art solutions. The holes are also positive since the reinforcing device do not need any pretreatment to make it stick to the elastomeric material, which otherwise would be needed.

According to an alternative embodiment compared to the one above, the annular body of the reinforcing device comprises a plurality of partitions extending between the inner ring and the outer ring, wherein the plurality of partitions together or with at least one of the inner ring or the outer ring forms the holes of the reinforcing device. In this embodiment, the annular body looks and function like a framework connected to the inner and outer ring.

According to an embodiment, the hub part comprises an insert arranged in the center hole of the hub part. The insert may be in plastic or in metal, but most preferred is a plastic insert. The insert acts as a vibration dampener and a silencer between the bar and the hub and the insert may be moulded to the hub/hub parts or may be a loose or pressed in place in the hub.

Further possible features and benefits of this solution will become apparent from the detailed description below.

BRIEF DESCRIPTION OF DRAWINGS

The solution will now be described in more detail by means of exemplary embodiments and with reference to the accompanying drawings, in which:

FIG. 2*a* is a front view of the weightlifting disc of FIG. 1.

FIG. 2*b* is a section view of the weightlifting disc of FIG. 2*a*.

FIG. 3*a* is a front view and FIG. 3*b* is a section view of an insert of the weightlifting disc of FIG. 1.

FIG. 3*c* is a section view and FIG. 3*d* is a front view of a first half of a hub part of the weightlifting disc of FIG. 1.

FIG. 3*e* is a front view and FIG. 3*f* is a section view of a second half of a hub part of the weightlifting disc of FIG. 1.

FIG. 4*a* is a side view of a disc part of the weightlifting disc of FIG. 1. and FIG. 4*b* is a section view of the disc part of FIG. 4*a*.

FIG. 4*c* is a side view of a reinforcing device of the weightlifting disc of FIG. 1. and FIG. 4*d* is a section view of the reinforcing device of FIG. 4*c*.

FIG. 4*e* is a side view of the weightlifting disc of FIG. 1. and FIG. 4*f* is a section view of the weightlifting disc of FIG. 4*e*, where the hub part is assembled to the disc part of the weightlifting disc.

DETAILED DESCRIPTION

Briefly described, an improved weightlifting disc of elastomeric material and comprising a reinforcing device, is disclosed.

Figure 1:
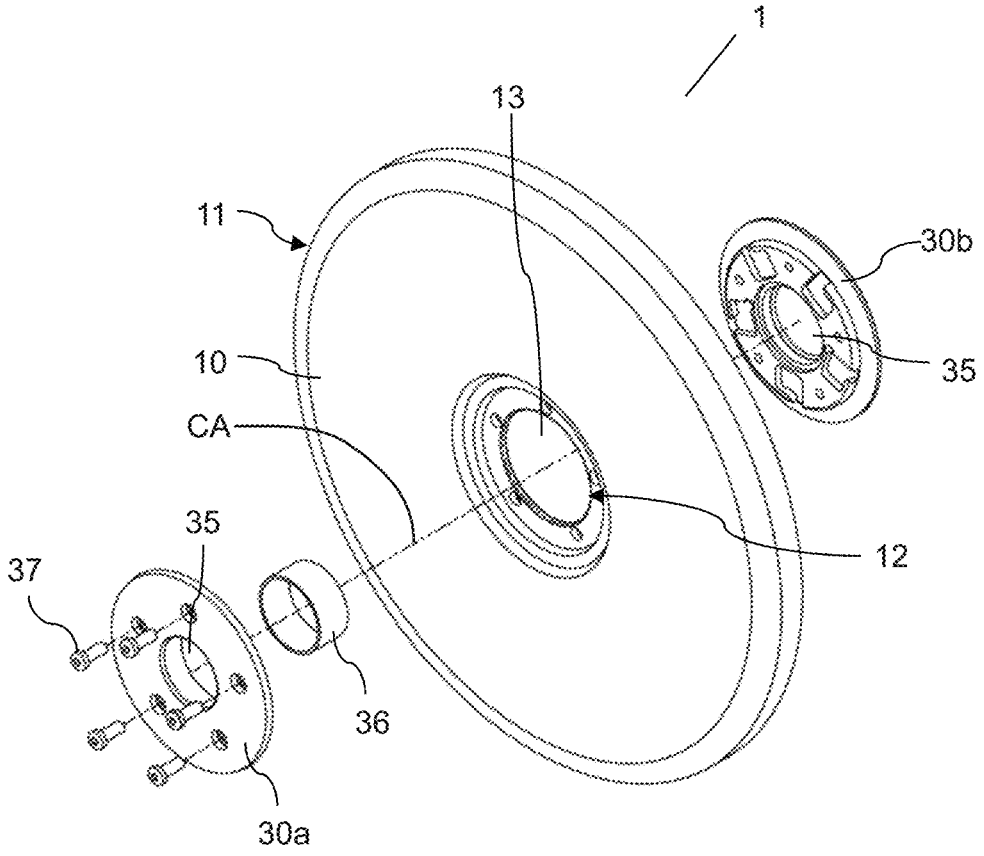
FIG. 1 is an exploded view of a weightlifting disc according to the invention.

FIG. 1 shows an exploded view of a weightlifting disc 1 according to the invention. The weightlifting disc 1, which not necessarily but more preferred is a circular disc, comprises a disc part 10 made of elastomeric material, preferably a rubber material or the like. The disc part 10 comprises an outer edge 11 and an inner edge 12, wherein the inner edge 12 is arranged close to a center 13 of the disc part 10 and the outer edge 11 of the disc part 10 is distal from the center 13 of the disc part 10.

The preferred embodiment of the weightlifting disc 10 further comprises a hub part 30 which comprises a first half 30*a* and a second half 30*b*. The hub part 30 is to be arranged at the center 13 of the disc part 10, such as the disc part 10 substantially surrounds the hub part 30 when the hub part 30 is arranged at the center 13 of the disc part 10. The hub part 30 is arranged to be attached at the inner edge 12 of the disc part 10, and the hub part 30 comprises a center hole 35 arranged for receiving a bar. The a first half 30*a* and a second half 30*b* of the hub 30 are connectable to each other, wherein at least the inner edge 12 of the disc part 10 is arranged to be pressed between the first and the second halves 30*a*, 30*b* of the hub part 30 when they are connected to each other. The first half 30*a* and a second half 30*b* are preferably fixedly connected to each other by means of screws 37. The hub part 30 may comprise an insert 36, which is to be arranged at the center hole 35 of the hub part 30. The insert 36 is arranged as a vibration dampener and a silencer between the bar and the hub 30 and the insert 36 may be moulded to the hub/halves 30*a*, 30*b* or may be a loose or pressed in place in the hub 30.

FIG. 2*a* is a front view of the complete weightlifting disc 1 comprising the hub part 30, arranged at the center 13 of the disc part 10. The outer edge 11 may normally have a flat or rounded surface. FIG. 2*b* is a section view at the center of the weightlifting disc 1, indicated by the dotted line and arrows. FIG. 3*a* is a front view and FIG. 3*b* is a section view of the insert 36 mentioned above. FIG. 3*c* is a section view and FIG. 3*d* is a front view of the first half 31*a* of the hub part 30 and FIG. 3*e* is a front view and FIG. 3*f* is a section view of a second half 30*b* of a hub part 30.

As can be seen in FIG. 2*b* the first and second halves 30*a*, 30*b* of the hub part 30 are mounted to the disc part 10 from a respective side of the disc part 10 and are fixedly attached to each other by screws 37, which are screwed from the first half 30*a* in direction to the second half 30*b* of the hub part 30. The insert 36 is in this embodiment a plastic cylinder fitted in the center hole 35 of the hub part 30. A reinforcing device 20 is arranged into the disc part 10, circumferentially around the center 13 of the disc part 10, between the outer edge 11 and the inner edge 12 of the disc part 10. The reinforcing device 20 and the disc part 10 are moulded together to a unit such as the elastomeric material (rubber) of the disc part 10 encloses the reinforcing device 20, such as the reinforcing device 20 is totally enclosed into the elastomeric material. For further information about the reinforcing device, please see description below relating to FIG. 4*a-f* and FIG. 5*a-b*.

The insert 36 preferably is a plastic cylinder like the insert 36 visible in FIG. 3*a-b*. According to an alternative embodiment the insert 36 may have an outer flange (see FIG. 5*b*) which flange then extends radially outwards a short distance from the cylinder body and by that rests at an outside of the halves 30*a*, 30*b* of the hub part 30.

The first and second halves 30*a*, 30*b* of the hub part 30, which are visible in FIG. 3*c-f*, preferably are disc-shaped metal hubs with a center hole 35, which halves as mentioned above, are connectable to each other on opposite sides of the disc part 10, such as the inner edge 12 of the disc part 10 is pressed between the first and the second halves 30*a*, 30*b* of the hub part 30 when they are connected to each other. The halves 30*a*, 30*b* are preferably screwed together by screws 37.

FIG. 4*a* is a side view of the disc part 10 and FIG. 4*b* is a section view of the disc part 10 of FIG. 4*a* in a section indicated by the dotted line and arrows. In the figures, the hub part 30 is not assembled to the disc part 10. As can be seen in the section in FIG. 4*b* the reinforcing device 20 is arranged circumferentially around the center 13 of the disc part 10, between the outer edge 11 and the inner edge 12 of the disc part 10, such as the reinforcing device 20 is totally enclosed into the elastomeric material of the disc part 10. As mentioned above, the reinforcing device 20 and the disc part 10 are moulded together to one unit. The inner edge 12 of the disc part 10 comprises a protruding part 12*a*, which protrudes radially towards the center 13 of the disc part 10, and the protruding part 12*a* is arranged to be attached to the hub part 30, i.e, the protruding part 12*a* is to be pressed between the first and second half 30*a*, 30*b* of the hub part 30, when the hub part 30 is mounted to the center 13 of the disc part 10, which may be seen in FIG. 4*f*.

FIG. 4*c-d* show the reinforcing device 20 in a side view respective a section view along the dotted line and indicated by the arrows in FIG. 4*c*. The reinforcing device 20 according to this preferred embodiment is ring-shaped and comprises a cylindrical inner ring 21, a cylindrical outer ring 22 and an annular body 23, which connects the inner ring 21 and the outer ring 22. In the preferred embodiment, the outer ring 22 is slightly wider than the inner ring 21 and the annular body 23 has a tapered extension from the wider outer ring 22 to the narrower inner ring 21. The annular body 23 of the reinforcing device 20 comprises a plurality of holes 25 circumferentially distributed spaced apart along the circular extension of the annular body 23 and which holes 25 are transverse relative the annular body 23. The holes 25 are arranged to accommodate elastomeric material of the outer disc part 10 such as, when the reinforcing device 20 and the disc part 10 are moulded to one piece, the elastomeric material fills the holes 25. By that, the total contact area between the elastomeric material of the disc part 10 and the reinforcing device 20 is very large, and the area for transferring impact forces between the disc part 10 and the reinforcing device 20 is thereby large. When moulding elastomeric material like rubber and incorporating another material into the mould, like the reinforcing device 20, the surface of the incorporated material normally must be pretreated to get a "grip" between the incorporated device and the rubber, but because of the transverse holes 25 in the annular body 23 of the reinforcing device 20, this is not necessary since the holes 25 provide a very good grip such as the reinforcing device 20 stays into the mould and "grips" the elastomeric material (rubber) in a very god way. Further, the ring-shape of the reinforcing device 20, with the inner ring 21 and outer ring 22, is very effective when taking care of impact forces since the "continuous" rings 21, 22 distributes the force better compared to if the rings were not continuous. The reinforcing device 20 is preferably made of metal or of plastic material.

FIG. 4*e* is a side view of the weightlifting disc 1 of FIG. 1. and FIG. 4*f* is a section view of the weightlifting disc 1 of FIG. 4*e* at a position indicated by the dotted line and arrows, and where the hub part 30 is assembled to disc part 10 of the weightlifting disc 1. The section of FIG. 4*f* shows how the hub part 30 is arranged at the center 13 of the disc part 10, such as the disc part 10 substantially surrounds the hub part 30. As mentioned above, the hub part 30 comprises the center hole 35 arranged for receiving a bar and the first half 30*a* and the second half 30*b* of the hub 30 are connected to each other, wherein at least the protruding part of the inner edge 12 of the disc part 10 is pressed between the halves 30*a*, 30*b* of the hub part 30. The hub part 30 is preferred to be a metal hub with a circular design and since the hub part 30 is in contact with the bar (not visible), the force from a drop of the barbell on the ground is transferred from the disc part 10 to the hub 30. But due to the reinforcing device 20, a substantial part of the force is transferred to the reinforcing device 20, which distributes the force over a large area before it is transferred to the hub 30, and the force at the contact surface between the hub part 30 and the bar by that is very low compared to if no reinforcing device would be arranged into the disc part 10, as in prior art.

Figure 5A:
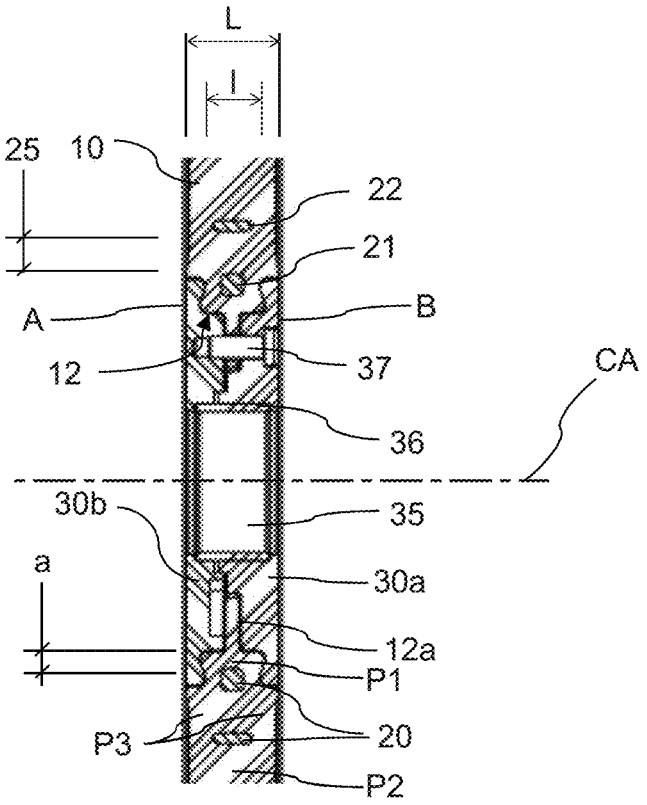
FIG. 5*a* is a zoomed section view of the hub part of the weightlifting disc with a first type of insert mounted to the hub part.

FIG. 5*a* is a zoomed section view of the hub part 30 of the weightlifting disc 1 with a first type of insert 36 mounted to the hub part 30. The section shows how the holes 25 of the reinforcing device 20 is filled with the elastomeric material of the disc part 10, and how the outer ring 22 and the inner ring 21 of the reinforcing device 20 is enclosed into the elastomeric material. The inner edge 12 of the disc part 10 is arranged such as the inner ring 21 of the reinforcing device 20 is arranged at a distance a from the inner edge 12 of the disc part 10, such that a first portion P1 of the elastomeric material is arranged between the inner edge 12 of the disc part 10 and the reinforcing device 20. The first half 30*a* and the second half 30*b* of the hub part 30 are fixedly attached to each other by screws 37 such as the inner edge 12 and its protruding part 12*a* is pressed between the halves 30*a*, 30*b*, wherein the hub part 30 is very robust attached to the disc part 10 and wherein there is elastomeric material between the hub 30 and the reinforcing device 20. The latter is shown to be very positive due to dampening characteristics and the total lifetime of the elastomeric weightlifting disc 1. Further, the insert 36 in the form of the cylinder-shaped insert 36 presented in FIG. 3*a-b*, is attached in the center hole 35 of the hub part 30. The insert 36 may be in plastic or in metal, but most preferred is a plastic insert 36. The insert 36 acts as a vibration dampener and a silencer between the bar and the hub part 30 and the insert 36 may be moulded to the hub/hub parts 30*a*, 30*b* or may be a loose or pressed in place in the hub part 30. Also shown is that a second portion P2 of the elastomeric material is located radially between the outer edge of the disc part and an outer edge of the reinforcing device, and a third portion P3 of the elastomeric material is located axially between the reinforcing device and respective side walls A, B of the disc part. And, an axial length I of the inner edge along a direction of a central axis CA (also see FIG. 1) is smaller than an axial distance L between the side walls of the disc part along the direction of the central axis.

Figure 5B:
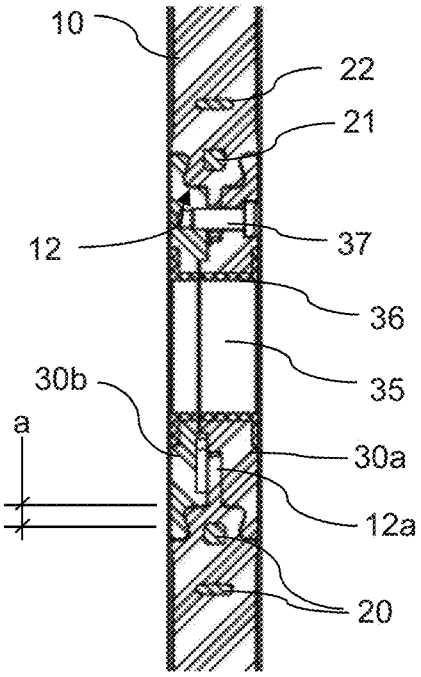
FIG. 5*b* is a zoomed section view of the hub part of the weightlifting disc with a second type of insert mounted to the hub part.

FIG. 5*b* is a zoomed section view of the hub part 30 of the weightlifting disc 1 with a second type of insert 36 mounted to the hub part 30. This second type is an alternative insert 36 which has an outer flange which extends radially outwards a short distance from the cylinder body and by that rests at an outside of the respective halves 30*a*, 30*b* of the hub part 30. The first and second halves 30*a*, 30*b* may be arranged with a recess to accommodate the flange of the insert 36 as may be seen in the figure.

Figure 6A:
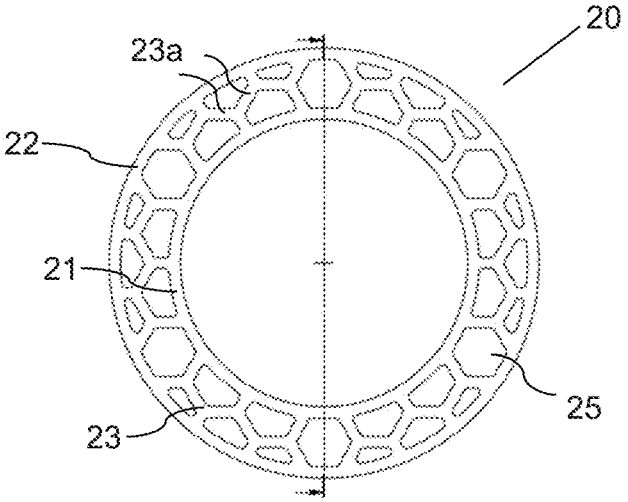
FIG. 6*a* is a front view of an alternative reinforcing device and FIG. 6*b* is a section view of the reinforcing device of FIG. 6*a*.
Figure 6B:
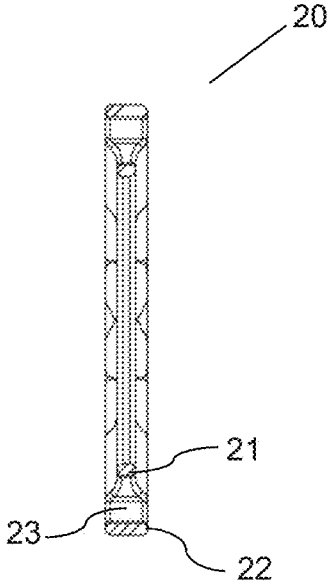

FIG. 6*a* shows a front view of an alternative reinforcing device 20 and FIG. 6*b* shows a section view of the reinforcing device of FIG. 6*a*. This type has the same functionality as the one described above (FIG. 4*c-d*) and is also ring-shaped and comprises a cylindrical inner ring 21, a cylindrical outer ring 22 and an annular body 23, which connects the inner ring 21 and the outer ring 22. In the preferred embodiment, the outer ring 22 is slightly wider than the inner ring 21 and the annular body 23 has a tapered extension, at least partly, from the wider outer ring 22 to the narrower inner ring 21. The annular body 23 comprises a plurality of partitions 23*a*, which extends between the inner ring 21 and the outer ring 22 in different directions and thereby forms a "pattern", such as the plurality of partitions 23*a* together or with the inner ring 21 and/or the outer ring 22 forms the holes 25 of the reinforcing device 20. The holes 25 have the same function as described above.

Although the description above contains a plurality of specificities, these should not be construed as limiting the scope of the concept described herein but as merely providing illustrations of some exemplifying embodiments of the described concept. It will be appreciated that the scope of the presently described concept fully encompasses other embodiments which may become obvious to those skilled in the art, and that the scope of the presently described concept is accordingly not to be limited. Reference to an element in the singular is not intended to mean "one and only one" unless explicitly so stated, but rather "one or more." All structural and functional equivalents to the elements of the above-described embodiments that are known to those of ordinary skill in the art are expressly incorporated herein and are intended to be encompassed hereby.

The invention claimed is:

1. A weightlifting disc that is mountable on a bar, the weightlifting disc comprising:

a disc part of elastomeric material, wherein the disc part comprises an outer edge and an inner edge, wherein the inner edge is arranged close to a center of the disc part and the outer edge of the disc part is distal from the center of the disc part, at least one reinforcing device encapsulated in the disc part circumferentially around the center, wherein the reinforcing device is located between the outer edge and the inner edge of the disc part, wherein an inner edge of the reinforcing device is further located at a predetermined distance from the inner edge of the disc part such that a first portion of the elastomeric material is located radially between the inner edge of the disc part and the inner edge of the reinforcing device, a second portion of the elastomeric material is located radially between the outer edge of the disc part and an outer edge of the reinforcing device, and a third portion of the elastomeric material is located axially between the reinforcing device and respective side walls of the disc part; and a hub part comprising a first half and a second half that are connected to each other and respectively located on opposite axial sides of the disc part with the inner edge of the disc part pressed between the first and second halves of the hub part, wherein an axial length of the inner edge along a direction of a central axis is smaller than an axial distance between the side walls of the disc part along the direction of the central axis, wherein the halves of the hub are respectively seated in indentations in opposite sides of the disc part that are formed by a difference between the axial distance between the side walls of the disc part and the axial length of the inner edge so that the second and third portions of the elastomeric material of the disc part radially surround the hub part and the first portion of the elastic material is located between the halves of the hub, and wherein the hub part comprises a center hole for receiving the bar; and wherein the reinforcing device comprises an outer ring, an inner ring, and an annular body that connects the outer ring and the inner ring, wherein the outer ring is wider than the inner ring along the direction of the central axis; and wherein the annular body is tapered in the radial direction between the outer ring and the inner ring.

2. The weightlifting disc according to claim 1, wherein the inner ring and the outer ring are cylindrical.

3. The weightlifting disc according to claim 2, wherein the annular body of the reinforcing device comprises a plurality of holes circumferentially distributed along the annular body and the holes transverse the annular body.

4. The weightlifting disc according to claim 2, wherein the annular body of the reinforcing device comprises a plurality of partitions extending between the inner ring and the outer ring, wherein the plurality of partitions together or with at least one of the inner ring or the outer ring forms holes through the reinforcing device.

5. The weightlifting disc according to claim 1, wherein the disc part further comprises a protrusion extending radially inward from the inner edge of the disc part, wherein the protrusion is axially narrower than the inner edge.

6. The weightlifting disc according to claim 5, wherein the hub part is attached to the protrusion.

7. The weightlifting disc according to claim 5, wherein the protrusion comprises through holes extending in the direction of the central axis, and wherein the halves of the hub are attached to each other with fasteners that extend through the through holes.

8. The weightlifting disc according to claim 1, wherein the reinforcing device is ring-shaped.

9. The weightlifting disc according to claim 1, wherein the reinforcing device comprises spaced holes in the direction of the central axis and wherein the third portion of the elastomeric material extends axially into each of the holes.

10. The weightlifting disc according to claim 1, wherein the reinforcing device is made of metal.

11. The weightlifting disc according to claim 1, wherein the reinforcing device is made of plastic.

12. The weightlifting disc according to claim 1, wherein the reinforcing device and the disc part are molded together to form a singular unit.

13. The weightlifting disc according to claim 1, wherein the hub part comprises an insert arranged in the center hole of the hub part.

14. The weightlifting disc according to claim 1, wherein each of the halves of the hub radially overlap with an inner ring of the reinforcing device.

15. The weightlifting disc according to claim 1, wherein force from an impact of the outer edge of the disc part with an object is transferred through the disc part to the reinforcing device and distributed by the reinforcing device before the force is transferred to the hub.

16. The weightlifting disc according to claim 1, wherein a radial length of the first portion of the elastomeric material is less than a radial length of the second portion of the elastomeric material.

17. The weightlifting disc according to claim 1, wherein a radial length from the inner edge of the disc part to the outer edge of the reinforcing device is less than a radial length of the second portion of the elastomeric material.

18. A weightlifting disc that is mountable on a bar, the weightlifting disc comprising:

a disc part of elastomeric material, wherein the disc part comprises an outer edge and an inner edge, wherein the inner edge is arranged close to a center of the disc part and the outer edge of the disc part is distal from the center of the disc part, and at least one reinforcing device encapsulated in the disc part circumferentially around the center, wherein the reinforcing device is located between the outer edge and the inner edge of the disc part, wherein an inner edge of the reinforcing device is further located at a predetermined distance from the inner edge of the disc part; and wherein the reinforcing device comprises an outer ring, an inner ring, and an annular body that connects the outer ring and the inner ring, wherein the outer ring is axially wider than the inner ring; and wherein the annular body is tapered in the radial direction between the outer ring and the inner ring.

* * * * *